US005526888A

United States Patent [19]

Gazewood

[11] Patent Number: 5,526,888

[45] Date of Patent: Jun. 18, 1996

[54] APPARATUS FOR AXIAL CONNECTION AND JOINDER OF TUBULARS BY APPLICATION OF REMOTE HYDRAULIC PRESSURE

[76] Inventor: Michael J. Gazewood, 860 Ridge Rd., Suite A, Duson, Lafayette, La. 70529

[21] Appl. No.: 304,069

[22] Filed: Sep. 12, 1994

[51] Int. Cl.[6] ..... E21B 17/06; E21B 23/00

[52] U.S. Cl. ..... 175/320; 166/242.6

[58] Field of Search ..... 175/320, 321; 166/242.6, 242.7, 377

[56] References Cited

U.S. PATENT DOCUMENTS

| | | | |
|---|---|---|---|
| 3,753,471 | 8/1973 | Kammerer, Jr. et al. | 175/320 |
| 3,842,914 | 10/1974 | Mott | 175/320 X |
| 4,815,540 | 3/1989 | Wallbillich, III | 166/377 |
| 4,984,632 | 1/1991 | Sampa et al. | 166/242.6 X |
| 5,105,890 | 4/1992 | Duguid et al. | 175/321 X |
| 5,127,482 | 7/1992 | Rector, Jr. | 175/321 |
| 5,219,027 | 6/1993 | Taylor | 166/377 |

FOREIGN PATENT DOCUMENTS

| | | | |
|---|---|---|---|
| 1477895 | 5/1989 | U.S.S.R. | 175/320 |

*Primary Examiner*—Hoang C. Dang

[57] ABSTRACT

Apparatus and method for disconnection and connection of tubular members, by remote pressure means, includes: First tubular housing having a male extension, second tubular housing having a mating female recess, latch blocks disposed radially in openings of the male extension, slotted piston for operating the latch blocks, pilot piston, detent lock-out mechanism operated by pilot piston movement, pilot piston shear pins, and piston bias/return springs.

The hydraulic disconnect is typically installed in a tubular work string where remote disconnection may be required. Latch blocks, extending radially through openings of the male extension and into annular grooves of the mating female recess, connect the first and second housings together. Fluid flow is permitted through axial bores of the first tubular housing, pilot piston, slotted piston and second tubular housing. Disconnection is accomplished by application of a pre-selected pressure differential across the pilot piston, typically by pumping a sealing ball to the pilot piston. Sufficient pressure differential overcomes shear pin means and the bias spring of the pilot piston causing it to axially shift. Movement of the pilot piston releases a lock-out mechanism allowing the slotted piston to axially extend. Extension of the slotted piston allows latch block retraction, thereby permitting the male and female bodies to axially disconnect. Re-connection follows a reverse process wherein pressure is applied to withdraw the latch block, the first and second housings are physically connected, and pressure is withdrawn to extend blocks and lock the housings together.

16 Claims, 4 Drawing Sheets

SECTION A

APPARATUS FOR AXIAL CONNECTION AND JOINDER OF TUBULARS BY APPLICATION OF REMOTE HYDRAULIC PRESSURE

BACKGROUND OF THE INVENTION

1. Field of Invention

The apparatus herein disclosed relates to apparatus and method for axial (without rotation) disconnection and/or joinder of tubular work string segments by application of fluid pressure from a remote source. Such method and apparatus have particular, but not exclusive, utility in the earth boring industry. Special utility exists for such method and apparatus when relatively flimsy tubing, such as coiled tubing, is employed in earth boring. In such boring it is frequently necessary to separate the drill string from the bottom-hole assembly in order to facilitate fishing, jarring, side-tracking or other operations. Remote connection and/or re-connection of tubular segments may be accomplished downhole, by application of fluid pressure from the surface, with the apparatus and method disclosed herein.

2. Description of Other Art

In many industrial applications there is some requirement for disconnection and joinder of tubular segments. When physical access to the separation point is convenient, and/or when application of torque on the tubulars is permissible, traditional connection/disconnection means such as threaded connections, flanged connections, hydraulic coupling and the like are frequently acceptable.

However, when access to the point of connection/disconnection is not possible, special procedures must be employed, even with threaded connections. For instance, in earth boring, the process of attempting to unscrew a threaded tubular connection at a particular point downhole is usually called "free pointing" and "backing off". That process involves complex calculations of the desired tensile force to be applied to the upper end of the drill string, balanced against the weight of the string, so that the net tensile and compressive forces at the point where the string is to be separated offset each other. If all of the threaded connections are made up of the same torque, are not damaged, and conditions are otherwise optimum, the string should unthread at said point ("neutral point"). Too frequently, however, conditions are not optimal, and "free pointing" is not successful. Further, it cannot be used where horizontal runs of work string are to be broken.

Further, when application of torque on the tubular string is impermissible (such as when relatively flimsy tubular goods, such as coiled tubing, are used), disconnection and/or joinder has, heretofore, been even more problematic. In coiled tubing operations, a frequent cause of losing pipe in a well is a stuck bottom-hole-assembly. Jars and accelerators, which are typically used to impart a jarring force to free stuck bottom-hole-assemblies, often cannot be included in a bottom-hole-assembly because their inclusion would lengthen the bottom-hole-assembly beyond the length which a pressure lubricator could accommodate. Hence, heretofore, when a coil-tubing bottom-hole-assembly became stuck, the coil-tubing had to be severed downhole with chemical charge, jet blast or external mechanical cutters inside of an over string ("wash pipe") of pipe. After severance of the work string the remaining tubing stub was then grasped with an overshot for fishing/jarring operations. Upon being freed the bottom-hole-assembly had to then be tripped to the surface for removal of the coil-tubing stub and re-connection to the tubing string.

Pre-installation of an axial disconnect, operable by pressure from a remote (surface) precludes many of such problems. A typical axial disconnect, operated by pressure from a surface source, is the FA or FAU "Safety Hydraulic Disconnect" known in the oilfield. In such disconnects a piston of variable diameter is used to radially retain projections on flexible fingers of a first housing in annular grooves of a recess of a second housing. Upon extension of the variable diameter piston a narrowed section of the piston permits the flexible fingers to move radially inward and release. Downhole re-connection is not possible with this type of tool as the fingers are normally extended and flex radially inward only when external force is applied. Also, inadvertent disconnection can occur during heavy jarring operations and the flexible fingers are prone to failure, particularly in highly tensile operations. Further, use of a variable diameter piston, requiring a narrowed section, may impose an undesirable flow restriction in the workstring.

The invention disclosed herein represents a substantial improvement over previous disconnects in that it may be used for both disconnection and joinder of tubular segments responsive to pressure from a remote source; its main operating piston is positively locked in place against jarring forces; its latch release mechanism does not employ a narrowed piston; and, its design avoids the failure problems associated with the use of flexible metallic fingers in a highly tensile applications.

OBJECTS OF THE INVENTION

The general object of this invention is to provide a new and improved pressure operable apparatus and method for axial (without rotation) disconnection and joinder of tubular goods.

One object of the invention is to provide a remotely operable axial disconnect for tubular members which is reversible, that is, it may be used to both disconnect and join tubular members by remote pressure means.

A further object of the invention is to provide a remotely operable, reversible axial disconnect for tubulars, which is highly resistant to inadvertent operation by jarring forces, and is also highly resistant to failure under highly tensile, compressive or shear conditions.

Another object of the invention is to provide a design which permits unrestricted flow of fluids during normal work string usage.

SUMMARY OF THE INVENTION

The apparatus herein disclosed is first characterized by a first tubular housing having a male extension which contains radial openings, a second tubular housing having a female recess containing annular grooves, a slotted piston disposed axially in the first housing, and, latch blocks moveable radially in the openings of the male extension responsive to axial movement of the slotted piston. The first tubular housing also includes a slotted piston bias spring, a pilot piston, pilot piston bias spring and shear pin means. Radially disposed apertures of the slotted piston, containing moveable elements cooperate with an annular groove of the pilot piston and an annular groove of the first tubular housing to form a detent lock-out mechanism. Said mechanism precludes extension of the slotted piston unless the pilot piston has first shifted in response to pressure disconnect signal.

The apparatus herein disclosed is typically installed in a tubular work string where disconnection may be anticipated at a later time. When disconnection is required, same may be accomplished by imposition of a pre-selected differential pressure across the pilot piston. Said pressure differential is typically generated by pumping a ball or plug downhole which seats against the pilot piston, but sufficient increase in fluid velocity through an axial bore of the pilot piston may also be used if such velocity is not precluded by other circumstance. When differential pressure across the pilot piston becomes sufficient to overcome the pilot piston shear pin and the resistance of the pilot piston bias/return spring, the pilot piston moves axially toward the slotted piston. Said movement of the pilot piston releases the lock-out mechanism of the slotted piston, permitting the slotted piston to extend axially (when sufficient hydraulic force to overcome the slotted piston bias/return spring is generated). Axial extension of the slotted piston moves a section of the slotted piston having broader slot spacing radially below the latch blocks, withdrawing said blocks radially from the annular grooves of female recess. Withdrawal of said blocks permits the male extension to be withdrawn axially from the female recess thereby completing disconnection of the two tubular housings. After disconnection release of pressure allows the bias springs of the respective (pilot and slotted) pistons to return said pistons to a "locked" position.

Remote joinder of tubular goods may be accomplished by a substantially reverse procedure as that employed for disconnection, except that the shear pins cannot be remotely replaced. In reconnection pressure is first applied to the first tubular housing causing the pilot piston to shift, slotted piston to extend and latch blocks to retract. Thereafter the male extension is matingly engaged in the female recess and pressure withdrawn. Withdrawal of pressure permits the bias/return springs of the respective pistons to return them to non-extended position. Return of the slotted piston to a non-extended position extends the latch blocks, thereby locking the first and second tubular housings together. After connection any ball or plug used to induce sufficient pressure differential may be withdrawn by reverse circulation through the workstring.

PREFERRED EMBODIMENT

While numerous embodiments of present invention are comprehended by the disclosures made herein, the embodiment hereinafter set forth represents that which I consider to be preferred. In its preferred embodiment, the apparatus herein disclosed includes the following major components: first tubular housing, 1, having threads, 11, annular groove, 14, and male extension, 12, which extension has radial openings, 13; second tubular housing, 2, having threads, 23, and female recess, 21, which recess has annular grooves, 22; latch blocks, 3; slotted piston, 4, having elongated longitudinal slots, 41, and radial apertures, 42; bias spring for slotted piston, 5; pilot piston, 6, having annular grooves, 61; bias spring for pilot piston, 7; shear pins, 8; and moveable elements, 9.

Figure 1:
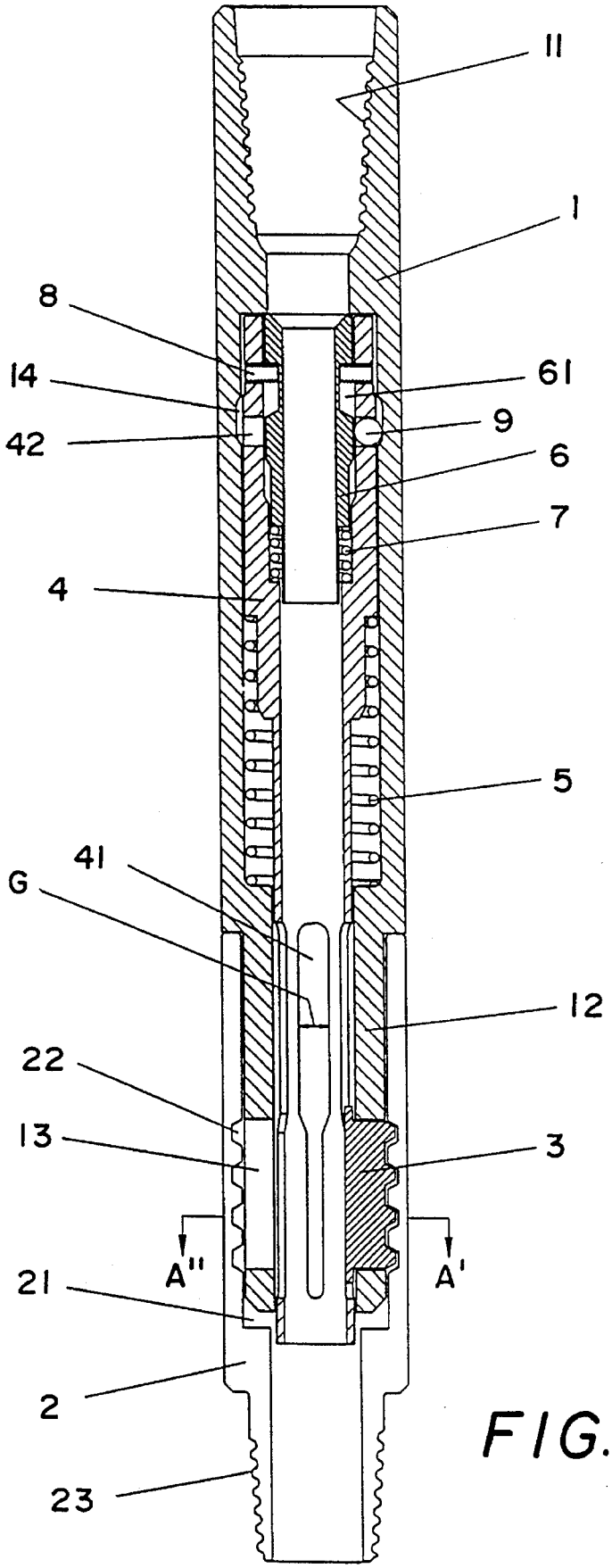
FIG. 1 is a side cut-away view of the invention in a connected and locked mode.

FIG. 1 schematically illustrates the position of said major components in a connected and locked mode. In said mode thread, 11, at the first end of first tubular housing, 1, and thread, 23, at the second end of second tubular housing, 2, are connected to respective members of a tubular work string and the apparatus forms an integral part of the work string. Axial bores through the first tubular housing, 1, pilot piston, 6, slotted piston, 4, and second tubular housing, 2, permit the passage of fluid through the apparatus.

In the connected and locked position male extension, 12, and female recess 21, are engaged in mating relationship and locked together by latch blocks, 3, extending through radial opening, 13, into annular grooves, 22. Latch blocks, 3, are held in extended position by the edges of slots, 41, operating on the tapering sides of the latch blocks (illustrated in FIG. 4). Slotted piston, 4, in turn, is held against axial extension, by slotted piston bias spring 5, and moveable elements, 9, contained in radial apertures, 42, interlocking with annular groove, 14, of first tubular housing, 1. As moveable elements, 9, have a diameter greater than the radial thickness of the radial apertures, 42, the moveable elements must extend at least partially either into groove 14 of the first tubular housing, 1, or groove 61 of pilot piston, 6. With pilot piston, 6, retracted (towards the first end of the first tubular housing) groove, 14, of the first tubular housing 1, is in longitudinal alignment with radial apertures, 42, of slotted piston, 4. Hence the elements, 9, must extend partially in radial apertures, 42, and partially into annular groove, 14, positively locking slotted piston, 4, to male body, 1; thereby precluding inadvertent extension of the slotted piston, 4.

Figure 2:
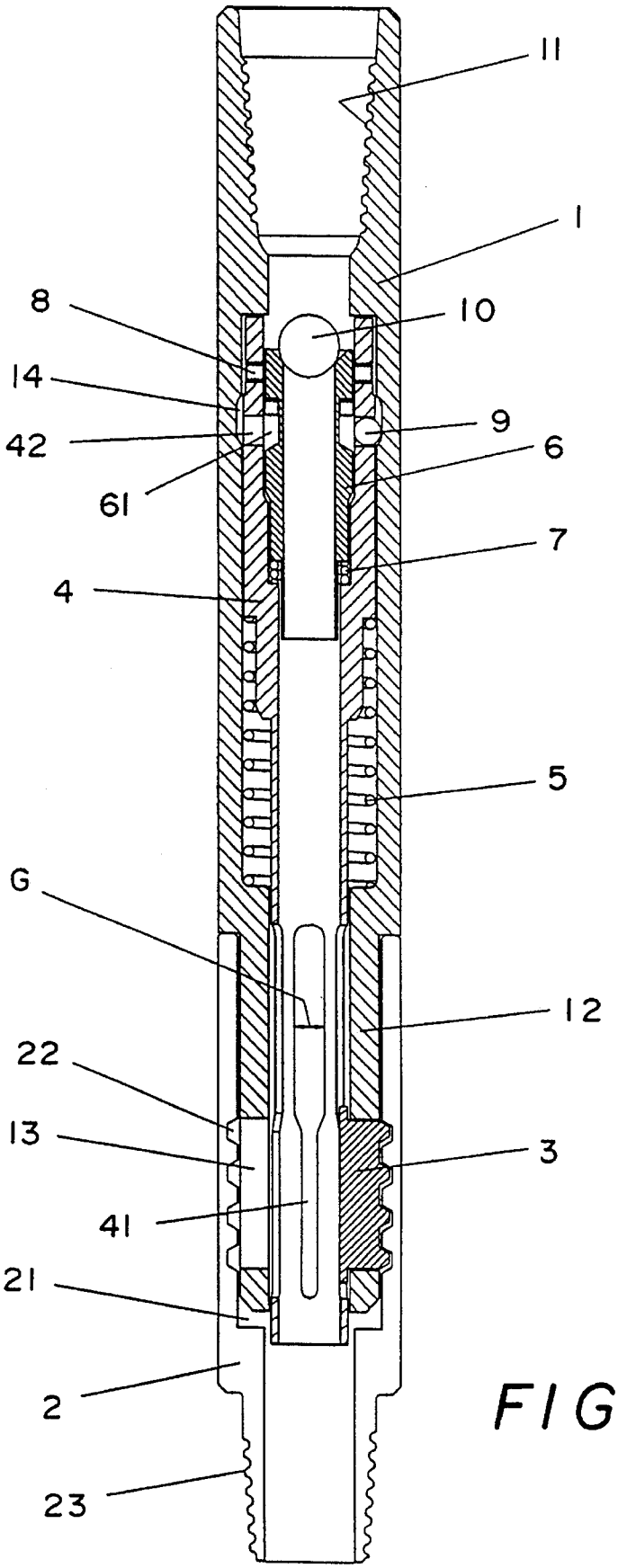
FIG. 2 is a side cut-away view of the invention after extension of the pilot piston but before extension of the slotted piston.

FIG. 2 schematically illustrates the tool of the present invention shortly after the initiation of a disconnection operation. Pilot piston, 6, has extended towards slotted piston, 4, but slotted piston, 4, has not yet moved. Ball, 10, has been pumped through the tubular work string to pilot piston, 6, to facilitate pressure increase across said pilot piston.

In order for slotted piston, 4, to have extended, certain prerequisites first occurred. First, sufficient axial force was asserted on pilot piston, 6, to cause shear pins, 8, to fail. Shear pins, 8, were selected or fabricated so as shear only on application of greater force than the weight of pilot piston, 6, multiplied by the maximum axial shock loading (G forces) anticipated on the workstring. Optimum resistance to inadvertent shearing is achieved by minimizing the weight of pilot piston, 6, and using the maximum strength shear pins as is possible without requiring hydraulic pressure greater than workstring pressure limitations to induce shearing. Likewise, by selecting an appropriately strong spring pilot piston bias spring, 7, a second means of providing a desired resistance to jarring forces may be chosen. By choosing a pilot piston bias spring constant that is substantial, and as compared to the weight of the pilot piston multiplied by the expected axial shock loading on the work string, resistance to inadvertent movement of the pilot piston due to jarring forces, independent of shear pins, 8, is provided. To maximize resistance to jarring forces the weight of the pilot piston, 6, is minimized and strength of the pilot piston bias spring, 7, is maximized (within permissible pressure range of the workstring wherein sufficient hydraulic force may be generated to overcome said spring). Sufficient hydraulic force will cause pilot piston, 6, to move axially and bring groove, 61, of pilot piston, 6, into alignment with radial apertures, 42, allowing moveable elements, 9, to shift from groove, 14, to groove, 61, thereby unlocking slotted piston, 4, from first tubular housing, 1. Upon unlocking of slotted piston, 4, the hydraulic force must then be sufficient to overcome the force of slotted piston bias spring, 5, to effect a disconnection operation. By selecting the slotted piston bias spring, 5, appropriately a desired hydraulic pressure may be chosen to effectuate actual disconnection.

Sufficient fluid pressure differential is typically generated across the pilot piston, 6, by circulating a sealing ball, 10, through the work string to the bore of pilot piston, 6, then increasing pump pressure against the deadheaded work string until release occurs. If the connection will not thereafter be rejoined, the plug, 10, may be retrieved when the work string is retrieved. If remote reconnection is made the sealing ball, 10, may be retrieved by reverse circulation of fluid through the workstring, and after retrieval normal circulation through the apparatus may resume.

Alternatively, hydraulic pressure forces sufficient to operate the apparatus may be generated without use of a sealing ball or plug, 10, by inducing high velocity fluid flow through the bore of pilot piston, 6. This manner of operation can be enhanced by reducing the diameter of the bore of pilot piston, 6, when said reduction is not inconsistent with flow rates required for other work string operations.

Figure 3:
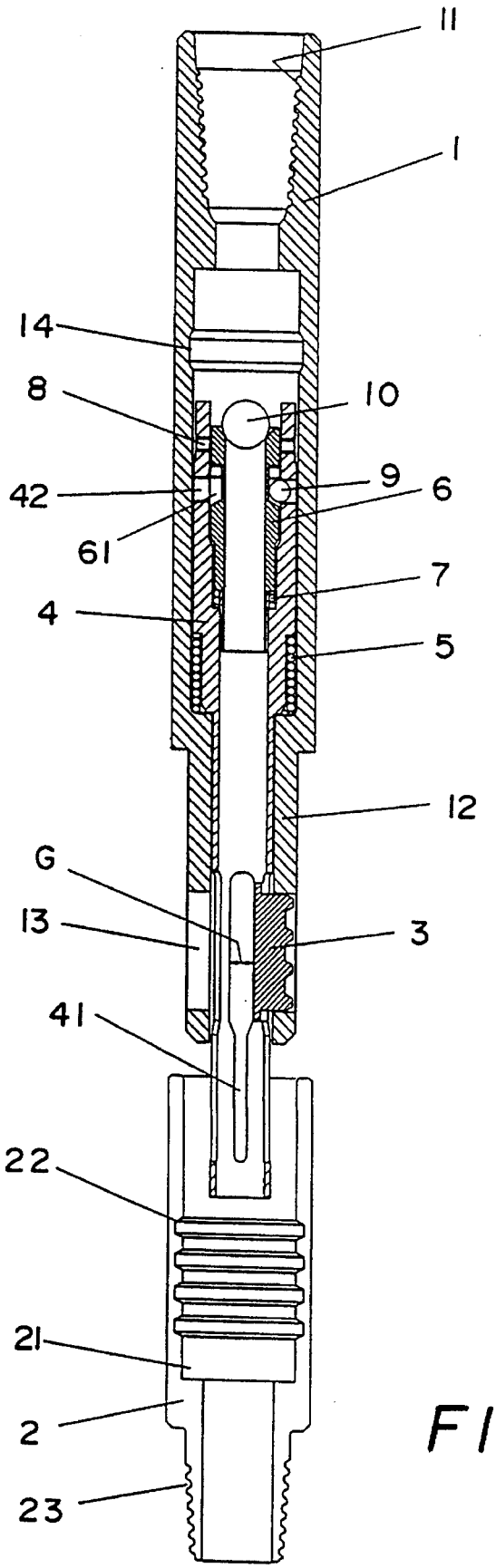
FIG. 3 is a side cut-away view of the invention with both pilot and slotted pistons extended and latch blocks withdrawn (as would be at the conclusion of a disconnection procedure or initiation of a connection procedure).

FIG. 3 schematically illustrates the tool of the present invention at the conclusion of a disconnect operation, or in position to begin a reconnection operation. In said mode, pressure exerted on plug or ball, 10, and pilot piston, 6, has compressed pilot piston spring, 7; and moveable elements, 9, have withdrawn from annular groove, 14, releasing slotted piston, 4. Slotted piston, 4, has compressed slotted piston spring, 5, and slotted piston, 4, has extended. As slots, 41, are wider, "G", (the opening or gap of the slot is larger) towards the first end of the first tubular housing, and the longitudinally disposed sides of latch blocks, 3, taper radially inward (see FIG. 4) and are slidably engaged in said gaps, 41, extension of slotted piston, 4, causes latch blocks, 3, to withdraw radially from annular grooves, 22, of the female recess, 21, of second tubular housing, 2.

Figure 4:
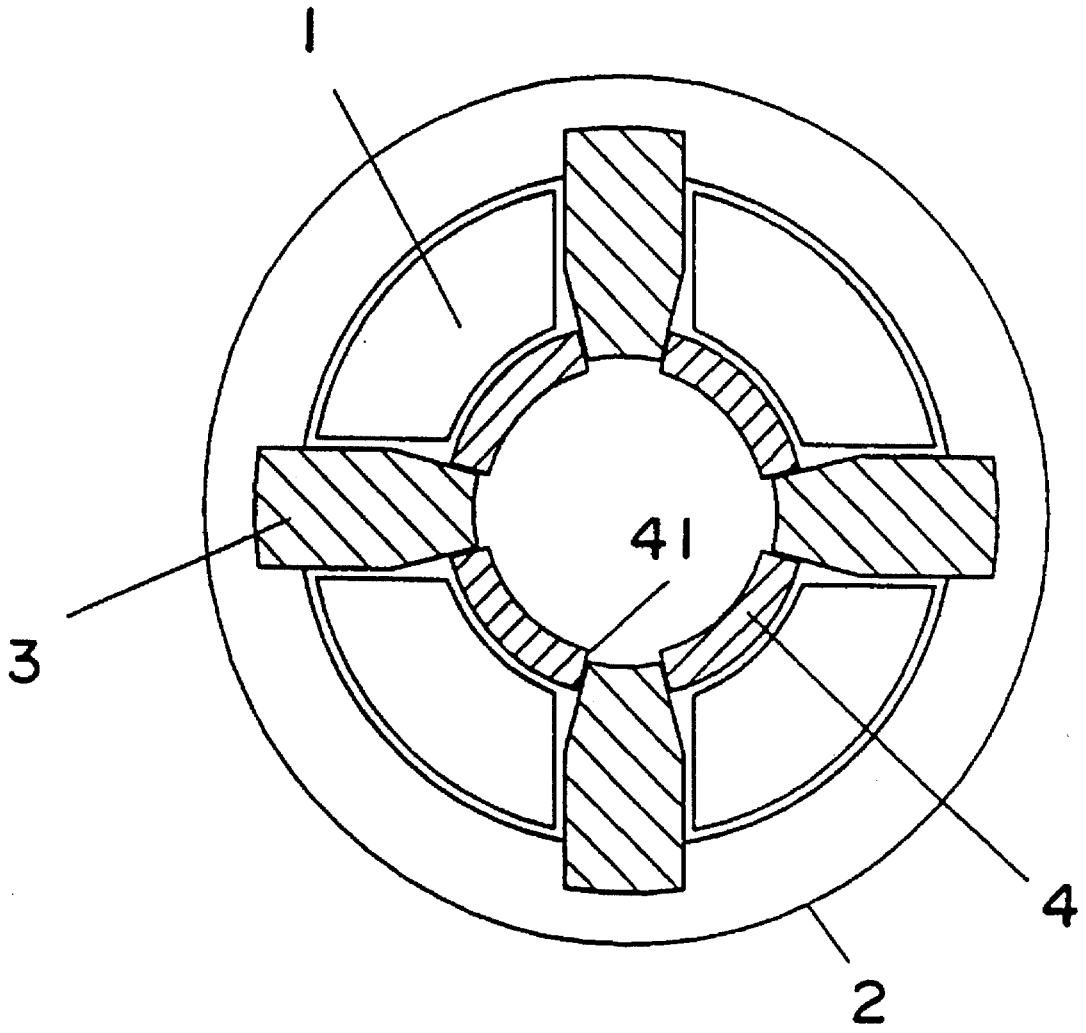
FIG. 4 is a cross-section view of the invention at line "A—A".

FIG. 4 is a longitudinal view of a cross-section of the present invention through line "A—A". As is seen in FIG. 4 the longitudinally disposed sides of latch blocks, 3, taper radially inward, and are slidably engaged with the sides of axial slots, 41, which are parallel to the adjacent side of an adjacent latch blocks, 3. Therefore, together, latch blocks, 3, and the sections of slotted piston, 4, disposed between slots, 41, form segments of a circular ring which has substantial resistance to radially inward forces.

Slots, 41, are each constructed so as to have a wide section disposed towards the first end of the first tubular housing, a narrow section disposed towards the second tubular member and a smooth transition step between the wide section and the narrow section (see FIGS. 1, 2, and 3). Consequently, when the narrow sections of gaps, 41, are contiguous with latch blocks, 3, as is the case when slotted piston, 4, is retracted, said latch blocks, 3, move radially outward; locking male extension, 11, and female recess, 21, together. Conversely, when the wider section of gaps, 41, are contiguous with latch blocks, 3, as is the case when piston, 4, is extended latch blocks, 3, retract inwardly into radial opening, 13, thereby unlocking male extension, 11, and female recess, 21.

The apparatus described above has particular utility in the field of earth boring with a continuous coiled tubing workstring. In such applications the preferred method for using the apparatus is, before insertion of the bottom hole/drilling assembly into the borehole, while at the surface, to threadably attach the second tubular member directly to the bottom hole/drilling assembly and to threadably attach the first tubular member directly to the coiled tubing workstring. Thereafter the bottom hole/drilling assembly, the interconnected apparatus and the coiled tubing workstring is run into the borehole, fluid circulation through the apparatus established and drilling commenced. In the event of a stuck bottom hole/drilling assembly tension is established on the workstring and a sealing ball is circulated through the workstring until it contacts with the pilot piston. Thereafter pressure in the workstring is increased until the disconnect operates, which is detected by relief of tension on the workstring. After disconnection the coiled tubing is retrieved and fishing operations may be conducted.

If rejoinder of the workstring to the bottom hole/drilling assembly is desired the coiled tubing, with the first tubular member of the apparatus attached, is run in the borehole until contact with second tubular member is made. Then a sealing ball is pumped down to the pilot piston and hydraulic pressure in the workstring is increased to at least the pre-determined pressure at which the apparatus will operate (which retracts the latch blocks). Thereafter the male extension of the first housing is lowered into the female recess of the second housing and the hydraulic pressure is released (to extend the latch block and lock the first and second housings together). After connection the sealing ball may be retrieved by reverse circulation through the workstring.

The above described embodiments should be regarded as only illustrative of the invention, of which many embodiments within the scope and spirit of the following claims may be described.

What is claimed is:

1. An apparatus for axial disconnection and joinder of a tubular work string by remote pressure means, comprising:

a) a first tubular housing having a first and a second end, wherein said first end is comprised of threaded means for attachment to a tubular work string and wherein said second end is comprised of a male tubular extension having a plurality of radially disposed openings;

b) a second tubular housing having a first and a second end, wherein said first end is comprised of a female recess compatibly sized to the male tubular extension of the first tubular housing and wherein said female recess also has at least one annular groove positioned adjacent to an opening of the male tubular extension of the first tubular housing when said extension of said first tubular housing is matingly engaged with the female recess of the second tubular housing and wherein said second end is comprised of threaded means for attachment to a tubular work string;

c) a main tubular piston, slidably disposed in the first tubular housing, having a first end and a second end, wherein the first end of said main tubular piston is disposed toward the first end of the first tubular housing and wherein the second end of said main tubular piston is disposed toward the second end of the first tubular housing and is comprised of a plurality of elongated slots and spaces therebetween, disposed longitudinally about the circumference of the main tubular piston, wherein each elongated slot is further comprised of a first section having greater circumferential width which is disposed toward the first end of the first tubular housing, a section of narrower circumferential width disposed towards the second end of the first tubular housing and a smooth tapering transition section between said first and said second sections of each said slot; and, d) a plurality of separately movable latch blocks having a first end and a second end, wherein said first end projects radially outward and is slidably disposed in the radial openings of the male tubular extension of the first tubular housing and wherein said second end projects radially inward, has radially inward tapering sides disposed parallel to the elongated longitudinal slots of the main tubular piston, and is engaged in said elongated longitudinal slots, wherein the spaces between the elongated longitudinal slots and the second end of the latch blocks form a segmented circular ring.

2. The apparatus of claim 1 further comprising compression spring means for biasing the main tubular piston towards the first end of the first tubular housing.

3. An apparatus for axial disconnection and joinder of a tubular work string by remote pressure means, comprising:

a) a first tubular housing having a first end, a second end and an inner diameter annular groove disposed between said first and said second ends, wherein said first end is comprised of threaded means for attachment to a tubular work string and wherein said second end is comprised of a male tubular extension having a plurality of radially disposed openings;

b) a second tubular housing having a first and a second end, wherein said first end is comprised of a female recess compatibly sized to the male tubular extension of the first tubular housing, wherein said female recess also has at least one annular groove positioned adjacent to an opening of the male tubular extension of the first tubular housing when said extension of said first tubular housing is matingly engaged with the female recess of the second tubular housing and wherein said second end is comprised of threaded means for attachment to a tubular work string;

c) a main tubular piston, slidably disposed in the first tubular housing, having a first end and a second end, wherein said first end is disposed towards the first end of the first tubular housing and is comprised of an axially disposed recess having a plurality of radial boreholes disposed about a circumference of said main tubular piston, and wherein said second end of said main tubular piston is disposed towards the second end of the first tubular housing;

d) a pilot piston slidably disposed in the axially disposed recess of the main tubular piston, wherein said pilot piston has an outer diameter annular groove; and, e) a plurality of detent elements, movably disposed in the radial holes of the axially disposed recess of the first end of the main tubular piston, wherein said detent elements are sized so as to radially protrude from the radial boreholes of the axially disposed recess of the first end of the main tubular piston.

4. The apparatus of claim 3 further comprising compression spring means for biasing the main tubular piston towards the first end of the first tubular housing.

5. The apparatus of claim 4 further comprising compression spring means for biasing the pilot piston toward the first end of the first tubular housing.

6. The apparatus of claim 3 further comprising compression spring means for biasing the pilot piston toward the first end of the first tubular housing.

7. The apparatus of claim 3 further comprising shear pin means for axially connecting the main tubular piston to the pilot piston disposed therein.

8. The apparatus of claim 4 further comprising shear pin means for axially connecting the main tubular piston to the pilot piston disposed therein.

9. The apparatus of claim 5 further comprising shear pin means for axially connecting the main tubular piston to the pilot piston disposed therein.

10. The apparatus of claim 6 further comprising shear pin means for axially connecting the main tubular piston to the pilot piston disposed therein.

11. An apparatus for axial disconnection and joinder of tubular members by remote pressure means, comprising:

a) a first tubular housing having a first end, a second end and an inner diameter annular groove disposed between said first and said second ends, wherein said first end is comprised of threaded means for attachment to a tubular work string and wherein said second end is comprised of a male tubular extension having a plurality of radially disposed openings;

b) a second tubular housing having a first and a second end, wherein said first end is comprised of a female recess compatibly sized to the male tubular extension of the first tubular housing, wherein said female recess also has at least one annular groove positioned adjacent to an opening of the male tubular extension of the first tubular housing when said extension of said first tubular housing is matingly engaged with the female recess of the second tubular housing and wherein said second end is comprised of threaded means for attachment to a tubular work string;

c) a main tubular piston, slidably disposed in the first tubular housing, having a first end and a second end, wherein said first end is disposed towards the first end of the first tubular housing and is comprised of an axially disposed recess having a plurality of radial holes disposed about a circumference of said main tubular piston, and wherein said second end of said main tubular piston is disposed towards the second end of the first tubular housing and is comprised of a plurality of elongated slots and spaces therebetween, disposed longitudinally about the circumference of the main tubular piston, wherein each elongated slot is further comprised of a first section having greater circumferential width which is disposed toward the first end of the first tubular housing, a section of narrower circumferential width disposed towards the second end of the first tubular housing and a smooth tapering transition section between said first and said second sections of each said slot;

d) a plurality of separately movable latch blocks having a first end and a second end, wherein said first end projects radially outward and is slidably disposed in the radial openings of the male tubular extension of the first tubular housing and wherein said second end projects radially inward, has radially inward tapering sides disposed parallel to the elongated longitudinal slots of the main tubular piston, and is engaged in said elongated longitudinal slots, wherein the spaces between the elongated longitudinal slots and the second end of the latch blocks form a segmented circular ring;

e) a pilot piston slidably disposed in the axially disposed recess of the main tubular piston, wherein said pilot piston has an outer diameter annular groove; and, f) a plurality of detent elements, movably disposed in the radial holes of the axially disposed recess of the first end of the main tubular piston, wherein said detent elements are sized so as to radially protrude from the radial boreholes of the axially disposed recess of the first end of the main tubular piston.

12. The apparatus of claim 1 further comprising compression spring means for biasing the main tubular piston towards the first end of the first tubular housing.

13. The apparatus of claim 12 further comprising compression spring means for biasing the pilot piston toward the first end of the first tubular housing.

14. The apparatus of claim 11 further comprising shear pin means for axially connecting the main tubular piston to the pilot piston disposed therein.

15. The apparatus of claim 12 further comprising shear pin means for axially connecting the main tubular piston to the pilot piston disposed therein.

16. The apparatus of claim 13 further comprising shear pin means for axially connecting the main tubular piston to the pilot piston disposed therein.

* * * * *